United States Patent [19]

Lavender

[11] 4,412,358

[45] Nov. 1, 1983

[54] INDIVIDUALLY FITTED HELMET LINER AND METHOD OF MAKING SAME

[75] Inventor: Michael R. Lavender, Vandling, Pa.

[73] Assignee: Gentex Corporation, Carbondale, Pa.

[21] Appl. No.: 382,420

[22] Filed: May 27, 1982

Related U.S. Application Data

[63] Continuation of Ser. No. 132,817, Mar. 24, 1980, abandoned.

[51] Int. Cl.[3] ..... A42B 3/00

[52] U.S. Cl. ..... 2/412; 2/419

[58] Field of Search ..... 2/412, 411, 413, 414, 2/415, 410, 417, 418, 419, 420

[56] References Cited

U.S. PATENT DOCUMENTS

| | | | |
|---|---|---|---|
| 3,552,044 | 1/1971 | Wiele | 2/412 X |
| 3,877,076 | 4/1975 | Summers et al. | 2/414 |
| 4,185,331 | 1/1980 | Nomiyama | 2/411 |

FOREIGN PATENT DOCUMENTS

| | | | |
|---|---|---|---|
| 2370448 | 6/1978 | France | 2/412 |
| 2387611 | 11/1978 | France | 2/413 |
| 1378494 | 12/1974 | United Kingdom | 2/414 |

OTHER PUBLICATIONS

Courvoisier, "Clothing Element Etc.", Nov. 1, 1979, Fig. 7, PCT Application PCT/CH79/00047.

*Primary Examiner*—Peter P. Nerbun
*Attorney, Agent, or Firm*—Shenier & O'Connor

[57] ABSTRACT

An individually fitted helmet liner includes a plurality of layers, each of which consists of a thermoplastic sheet formed with an array of pockets receiving the major portions of energy-absorbing spheres, the spheres of one layer being in register with the spaces between the spheres of an adjacent layer. The liner is fitted to an individual wearer's head by heating the sheets to a plastic state, placing the liner between an outer shell and the wearer's head, and applying tension to the layers around their periphery to deform the sheets to a degree determined by the relative position of the spheres. A mold member for use in making the individual resin-sphere layers and a method employing the mold member to make such layers are also disclosed.

13 Claims, 12 Drawing Figures

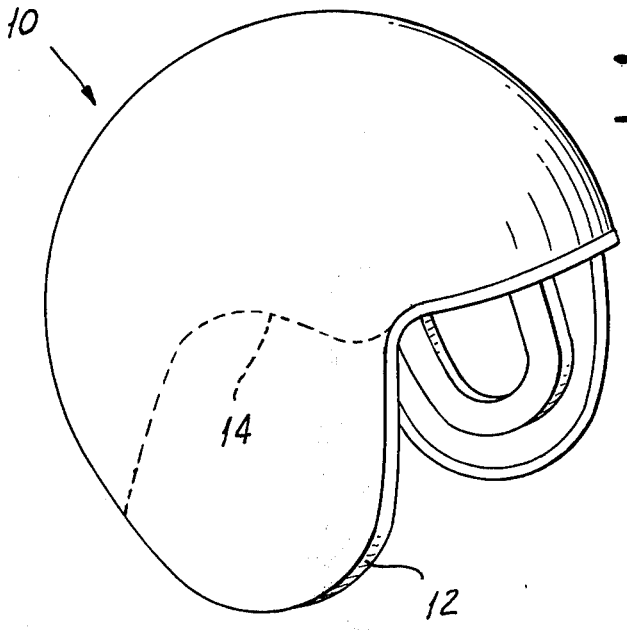
FIG 1
FIG 2
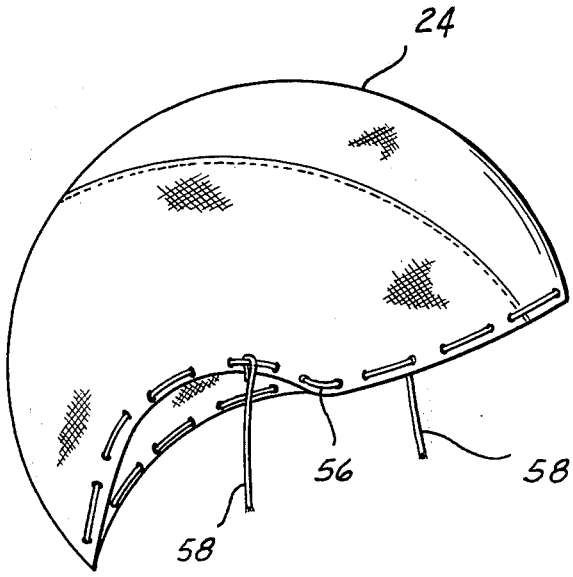

Fig 3
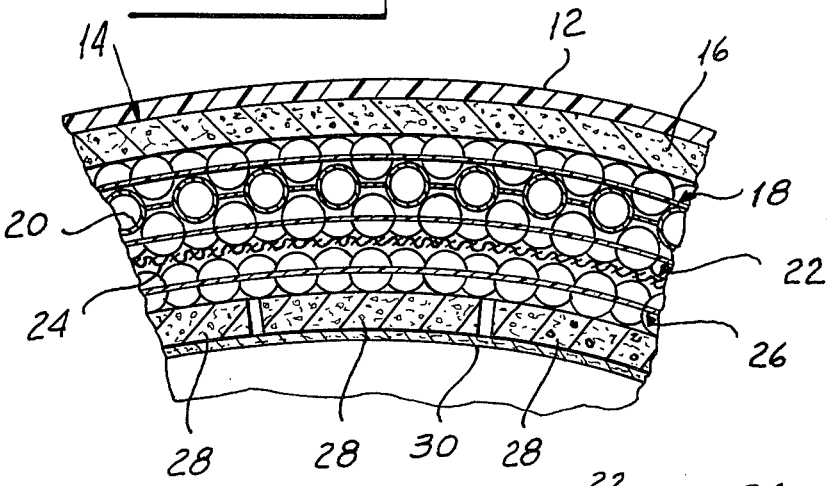
Fig 4
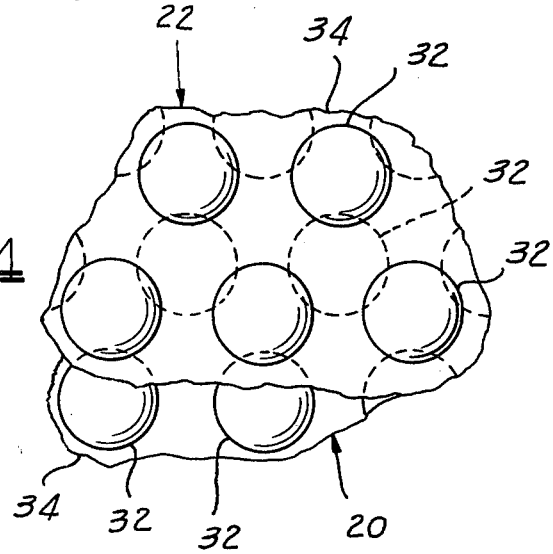
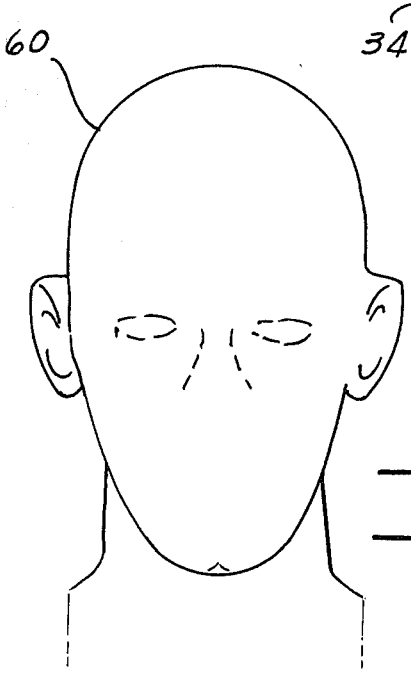
Fig 5

Fig 6
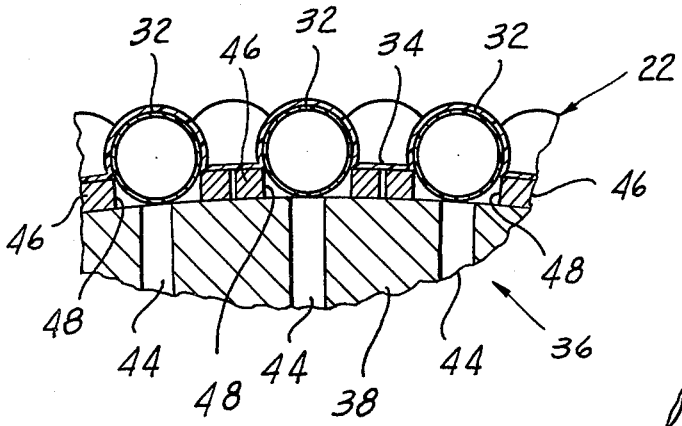
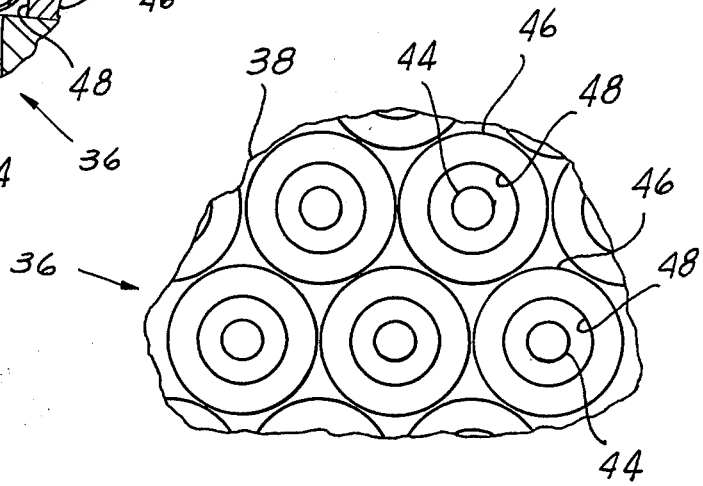
Fig 7
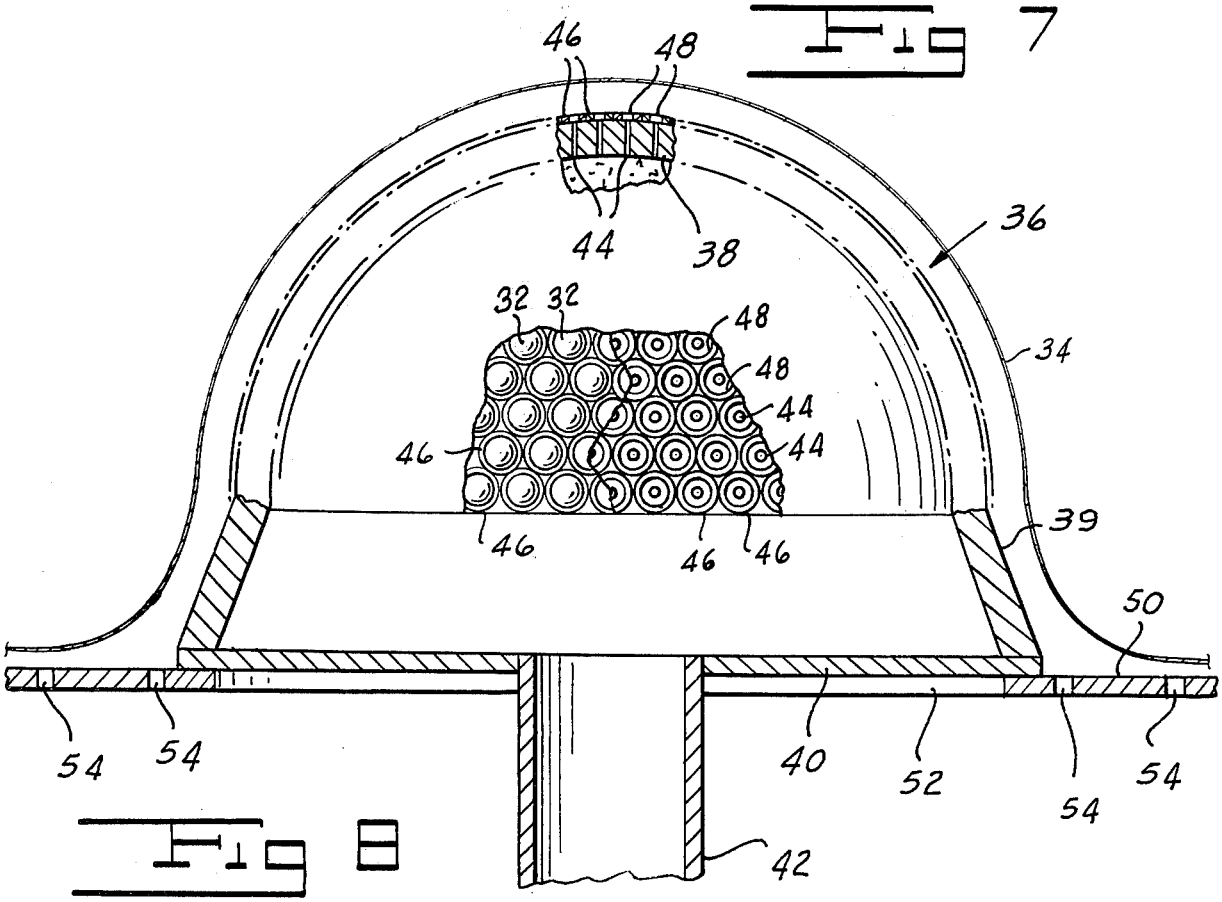
Fig 8

Fig 9
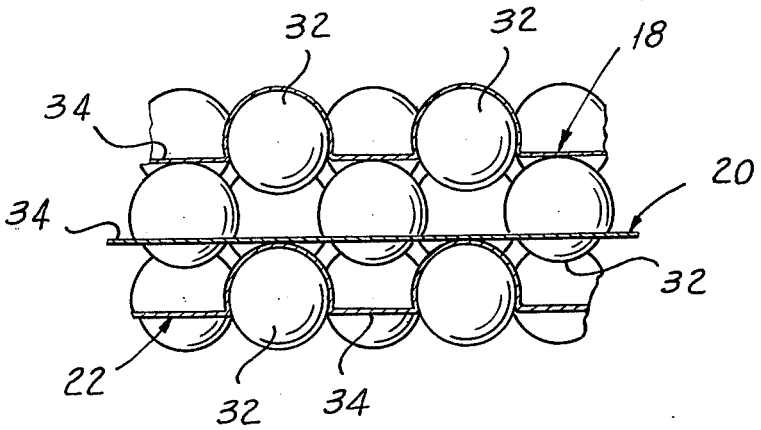
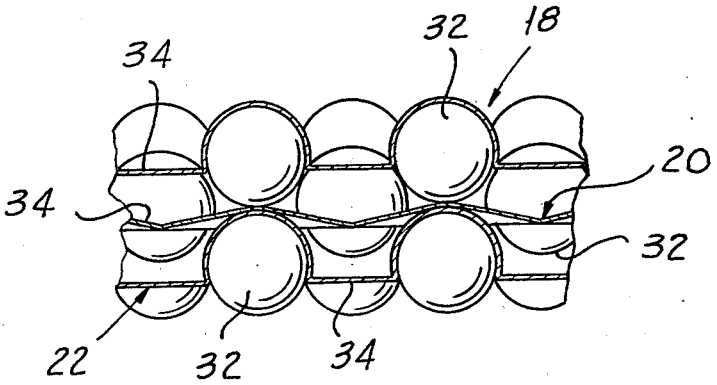
Fig 10
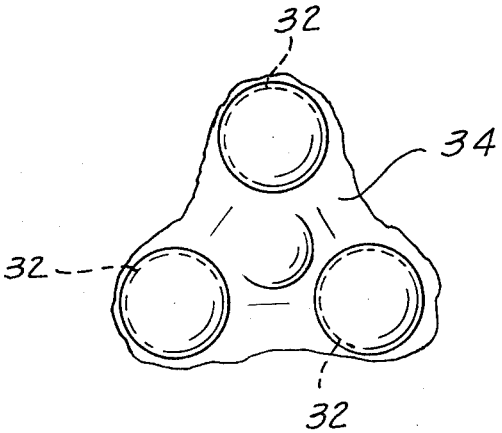
Fig 11

INDIVIDUALLY FITTED HELMET LINER AND METHOD OF MAKING SAME

This is a continuation of application Ser. No. 132,817, filed Mar. 24, 1980 now abandoned.

BACKGROUND OF THE INVENTION

Protective helmets having hard outer shells for use in various military, industrial or other applications are well known in the art. In such helmets, it is generally desirable to provide a resilient liner assembly between the outer shell and the wearer's head to help absorb shock. While straps or similar elements have customarily been used in the past for this purpose, they must be adjustable to accommodate various head sizes, resulting in some wobbling from front to back or from side to side.

Various proposals for custom-fitted liner assemblies have been suggested in an attempt to overcome this defect. According to one known method of making a custom-fitted helmet, disclosed in Morton U.S. Pat. No. 3,882,546, the outer helmet shell is spaced a suitable distance from the wearer's head and foam is injected into the region between the outer shell and an elastic layer closely overlying the wearer's head. The necessity of directly handling the foaming agent limits the utility of this method in the field.

According to another method of making a custom-fitted helmet, dislcosed in Chisum U.S. Pat. No. 4,100,320, the helmet liner is preformed with a plurality of adjacent pairs of cells respectively containing the first and second components of a foamable mixture. After the liner is placed between the helmet shell and the wearer's head, the cell partitions separating the first and second components are removed to initiate the foaming process. While this method avoids direct exposure to the liner foam, the complexity and hence expense of the preformed liner limit its practical application. Both of those methods, moreover, are one-shot procedures in that they do not permit subsequent adjustment of the liner to accommodate a different wearer or a changed head size.

SUMMARY OF THE INVENTION

One of the objects of my invention is to provide an individually fitted helmet liner which may be fitted to a wearer's head rapidly and in a simple manner.

Another object of my invention is to provide an individually fitted helmet liner which may be refitted to accommodate a changed head size.

Still another object of my invention is to provide an individually fitted helmet liner which has uniform and hence predictable structural characteristics.

A further object of my invention is to provide an individually fitted helmet liner which does not require trimming after fitting.

Yet another object of my invention is to provide an individually fitted helmet assembly which compensates for "hot spots" due to shifting of the helmet relative to the wearer's head.

Other and further objects will be apparent from the following description.

In general, my invention contemplates a helmet liner in which a sheet conforming generally to the top of the wearer's head is disposed between a first plurality of spacers on one side of the sheet and a second plurality of spacers on the other side of the sheet in staggered relationship with the first plurality of spacers. The liner is fitted to an individual wearer's head by deforming the sheet to adjust the extent to which the first plurality of spacers extend in the direction of the sheet between the second plurality of spacers.

Preferably the spacers comprise energy-absorbing elements, while the sheet comprises a thermoplastic material which is suitably deformed by heating the sheet to a plastic state, placing the liner between an outer shell and the wearer's head to move the spacers together to the desired extend, and tautening the sheet to urge it against the spacers and deform the sheet to a degree determined by the relative position of the spacers.

In a highly preferred form of my invention, the helmet liner comprises a plurality of layers, each of which consists of a thermoplastic sheet formed with an array of pockets receiving the major portions of energy-absorbing spheres. Adjacent layers are so arranged relative to each other that the spheres of one layer are in register with the spaces between the spheres of the adjacent layer.

In another aspect, my invention contemplates a mold member for use in making a resin-sphere layer which has a generally hemispherical wall formed with apertures over the surface thereof and which has an inlet for coupling to a source of atmospheric pressure source.

In yet another aspect, my invention contemplates a method of making an individual resin-sphere layer using such a mold member in which I first couple the inlet of the member to the subatmospheric pressure source. After dipping the mold member into a supply of globes greater in diameter than the apertures to draw portions of the globes into the apertures, I place the mold member with the globes over the bed of a vacuum mold while maintaining the coupling to the source of subatmospheric pressure. I then apply a vacuum to the mold bed and drape a plasticized sheet of synthetic resin over the mold member to allow the vacuum to draw the sheet down over the mold member and the globes carried thereby.

BRIEF DESCRIPTION OF THE DRAWINGS

In the accompanying drawings to which reference is made in the instant specification and in which like reference characters are used to indicate like parts in the various views:

FIG. 1 is a perspective view of a helmet incorporating my individually fitted liner.

FIG. 2 is a perspective view of the cloth mesh layer of the liner of the helmet shown in FIG. 1.

FIG. 3 is an enlarged fragmentary section of the helmet shown in FIG. 1 illustrating the arrangement of the various layers of my liner.

FIG. 4 is an enlarged fragmentary bottom plan of the liner of the helmet shown in FIG. 1 in an intermediate stage of construction illustrating the staggered arrangement of adjacent resin-sphere layers.

FIG. 5 is a front elevation of a sizing headform used in the fabrication of the liner of the helmet shown in FIG. 1.

FIG. 6 is an enlarged fragmentary section of a vacuum-forming mold used to fabricate the resin-sphere layers of my helmet liner, shown with a resin-sphere layer on the mold.

FIG. 7 is an enlarged top plan of the portion of the mold shown in FIG. 6 with the resin-sphere layer removed.

FIG. 8 is a fragmentary elevation, shown partly in section, of the vacuum-forming mold and vacuum bed used to fabricate the resin-sphere layers of my helmet liner, shown with a sheet draped over the mold and with spheres covering part of its surface.

FIG. 9 is an enlarged fragmentary section of the liner of the helmet of FIG. 1 in an intermediate stage of construction, illustrating one spacing of the resin-sphere layers.

FIG. 10 is an enlarged fragmentary section of the liner portion shown in FIG. 9, illustrating another spacing of the resin-sphere layers.

FIG. 11 is an enlarged fragmentary top plan of the liner portion shown in FIG. 9, with the resin-sphere layers spaced as in FIG. 10.

DETAILED DESCRIPTION OF THE PREFERRED EMBODIMENT

Figure 12:
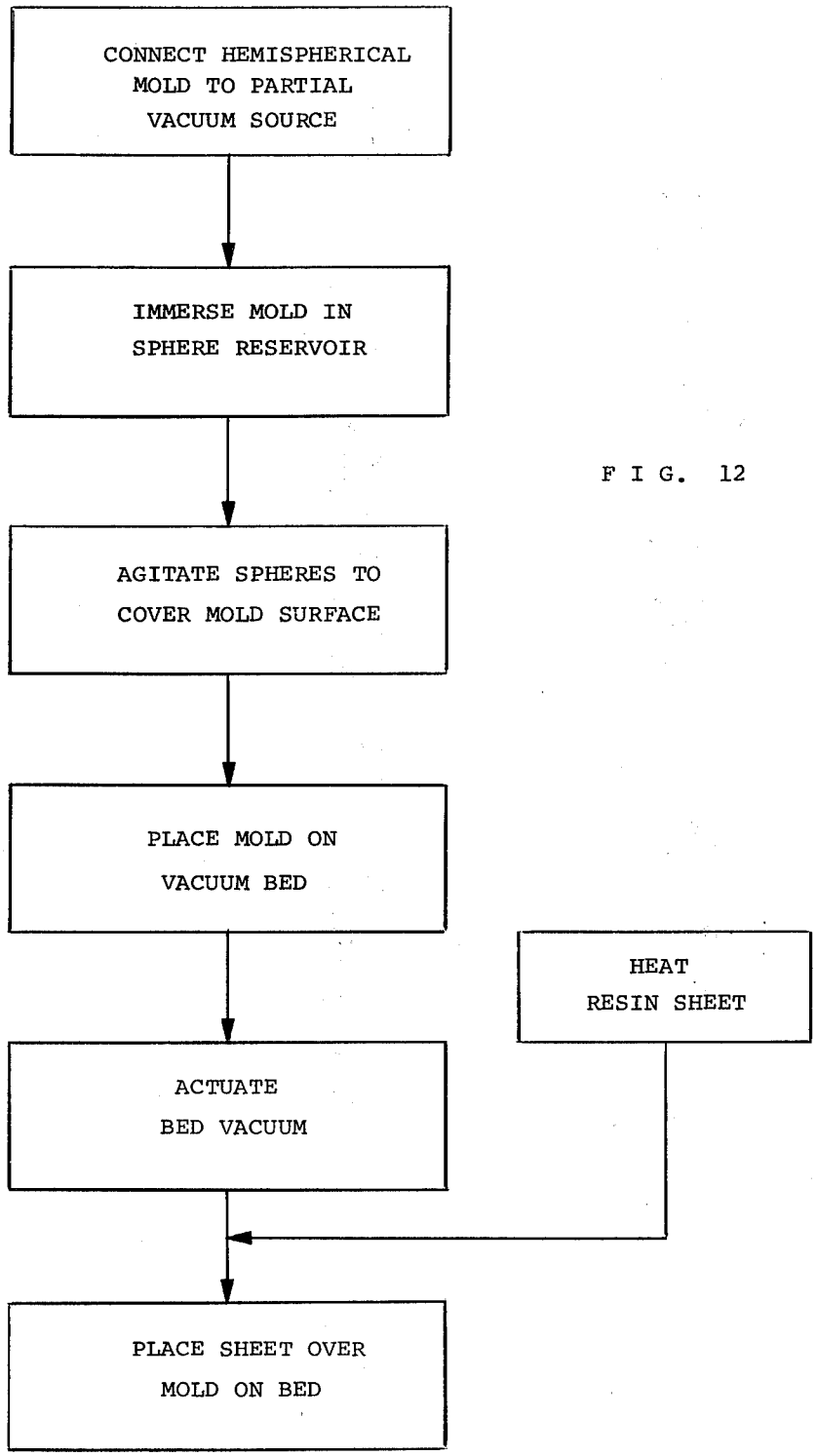
FIG. 12 is a flow diagram illustrating the process steps typically involved in making a resin-sphere layer.

Referring now to FIGS. 1 and 3, a completed helmet assembly constructed according to my invention, indicated generally by the reference numeral 10, includes a rigid outer shell 12, formed of a suitable ballistic material, and an inner liner assembly 14. Liner 14 comprises, in order from the shell 12 inward, a polystyrene foam layer 16; three identical resin-sphere layers 18, 20 and 22, to be further described; a cloth mesh layer 24, to be further described; another resin-sphere layer 26, identical to layers 18, 20 and 22; a layer consisting of discrete circular foam pads 28; and finally an inner leather lining 30. As shown in FIG. 6, each resin-sphere layer 18, 20, 22 or 26 comprises a plurality of spaced energy-absorbing spheres 32 such as resilient hollow epoxy balls or spheres captured in a vacuum-formed thermoplastic sheet 34 such as a sheet of ethylene-vinyl acetate.

Referring now to FIGS. 6 to 8, I form the resin-sphere layers 18, 20, 22 and 26 using a mold indicated generally by the reference numeral 36. Mold 36 comprises a generally hemispherical wall 38, about one-half inch thick, carried by an imperforate support 39 closed by a bottom plate 40. An air inlet 42 couples the interior of the mold 36 to a suitable vacuum source (not shown). A plurality of relatively narrow air conduits 44 in wall 38, corresponding in spacing to the desired spacing of the spheres 32, provide flluid communication between the exterior and interior of the mold 36. Suitable annular spacers 46 formed with central apertures 48 are adhered to the outer side of the hemispherical wall 38 in register with conduits 44 to form an array of cylindrical recesses for receiving the spheres 32. Preferably, spacers 46 are so disposed that the center-to-center spacing between adjacent spheres 32 of a resin-sphere layer is about one and two-thirds of the diameter of each sphere. The cylindrical depressions formed by spacers 46 preferably have a depth of about one-third of the diameter of the spheres 32 so that the sheets 34 of the completed resin sphere layers 18, 20, 22 and 26 enclose portions of the spheres 32 equal in height to about two-thirds of the sphere diameter.

Referring now to FIG. 12, to make a resin-sphere layer 18, 20, 22 or 26, the vacuum source (not shown) coupled to the interior of mold 36 through inlet 42 is actuated and the entire mold 36 is dipped into a container (not shown) holding the spheres 32. Using the hands, the operator distributes these spheres onto each of the spacers 46 on the mold 36 as shown in FIGS. 6 and 8. The mold 36 is then placed on the bed 50 of a vacuum-forming machine. The bed 50 contains a plurality of small apertures 54 through which the upper region is subjected by suitable means (not shown) to a vacuum from below, as well as a larger aperture 52 for accommodating the vacuum inlet 42 of the mold 36. A sheet 34 is then heated sufficiently to render it plastic. After the vacuum supplying the bed 50 is turned on, the sheet 34 is draped over the mold 36 as shown in FIG. 8. When the sheet 34 has been molded into the desired configuration, shown in FIG. 6, it is allowed to cool to an elastic state and then removed from the mold 36 and cut to the shape of the liner 14.

Cloth mesh layer 24 has a cord 56 sewn around its periphery, as shown in FIG. 2. A pair of side tension cords 58 are attached to cord 56 at one or more points along the respective sides of mesh layer 24 so that, when cords 58 are drawn downward, the mesh layer 24 is pulled downwardly and, at the same time, contracted about its periphery.

Preferably the overall inside dimensions of the liner 14 should not change more than about plus or minus $\frac{1}{4}$ inch when fitted to individual subjects. To accommodate a typical range of expected head sizes while maintaining this standard, I form the liner 14 in six basic sizes, using differently sized headforms, such as the headform 60 shown in FIG. 5, to determine the size and shape of the different layers during fabrication and assembly.

All of the layers 16 to 30 forming the liner 14 are bonded together with a suitable contact adhesive. Hook-and-loop fastener strips such as those sold by American Velcro, Inc., under the trademark "Velcro" may be used instead of adhesive at one interface to allow for component maintenance. Similarly, the liner 14 is itself attached to the shell 12 before fitting, either with a suitable adhesive or with fasteners of the type described above.

As shown in FIGS. 4 and 9 to 11, the sphere positions of adjacent resin-sphere layers 18, 20, 22 and 26 are staggered so that the spheres 32 of one layer, layer 20 for example, are in register with the centers of the spaces between the spheres of an adjacent layer, layer 22 for example. In this manner, adjacent resin-sphere layers 18, 20, 22 and 26 nestle together to an extent depending on the degree to which the sheets 34 are deformed to accommodate the spheres of adjacent layers. Thus, if the sheets 34 are flat in the areas between the spheres 32, as in FIG. 9, adjacent sheets 34 will, neglecting sheet thickness, be separated by a spacing corresponding to the height of the portion of spheres 32 enclosed by sheets 34.

If, on the other hand, the sheets 34 are deformed in the areas between the enclosed spheres 32 to accommodate the spheres of an adjacent sheet, as shown in FIGS. 10 and 11, the sheets 34 may be spaced more closely, down to a minimum separation equal to the radius of a sphere. Thus, by deforming the sheets 34 to the desired extent while in a plastic state and then cooling the sheets to cause them to set with that deformation, the effective thickness of a plurality of resin-sphere layers 18, 20, 22 and 26 may be readily adjusted within a particular sizing range.

To custom-fit the shell-and-liner assembly 10 to a wearer's head, the entire assembly is heated in an oven for about 5 to 10 minutes at about 120° F., the exact heating time and temperature depending on the thermoplastic used, to bring the sheets 34 forming layers 18, 20, 22 and 26 to a plastic deformable state. The shell-and-liner assembly 10 is then removed and placed on the wearer's head to push the adjacent layers 18, 20 22 and 26 together to the desired extent. During the next 2 or 3 minutes, while the sheets 34 are cooling and rigidifying, either the wearer or the fitter holds down the free ends of the tension cords 58 to tauten the sheets 34 to urge them against the spheres 32 of adjacent sheets. After the layers 18, 20, 22 and 26 cool to a rigid, nonplastic state, the sheets 34 forming the layers remains deformed in the areas of spheres 32 of adjacent sheets to provide the desired accommodation to the wearer's head. This procedure may be followed repeatedly to refit the liner 14 either to a different individual or to the same individual with a changed head size, so long as the new size is within the sizing range of plus or minus about ¼ inch mentioned above. Thus, my liner readily accommodates size changes due, for example, to changed hair length or bumps on the head.

Because of the resin-sphere layers 18, 20, 22 and 26, the liner 14 has a slight elasticity which increases with temperature up to about 105° to 110° F., after which point the layers 18, 20, 22 and 26 begin to become plastic and lose their "memory" of their shape. This temperature-dependent elasticity tends to compensate for "hot spots", or points of friction or increased pressure which are due to shifting of the helmet relative to the wearer's head and are perceived as uncomfortable. Wherever there is any significant frictional contact between the liner 14 and the wearer's head, the resulting increase in temperature will increase the elasticity of layers 18, 20, 22 and 26 in the region of such contact. Owing to this increased elasticity, the normal force exerted by the liner 14 in that region against the wearer's head drops, in turn reducing the frictional force due to shifting movement.

It will be seen that I have accomplished the objects of my invention. My helmet liner may be fitted to a wearer's head rapidly and in a simple manner. My helmet liner may be refitted to accommodate a changed head size, and has uniform and hence predictable structural characteristics. My helmet liner does not require trimming after fitting. Finally, my helmet liner compensates for hot spots due to shifting of the helmet relative to the wearer's head.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention what I claim is:

1. A helmet liner including in combination a plurality of layers conforming generally to the top of a wearer's head, said layers being assembled in superposed contacting relationship with one another and each comprising a sheet having spaced projections on at least one side thereof, said sheets being elastic at normal temperatures and plastically deformable at elevated temperatures to permit adjustment of the effective thickness of said liner.

2. A helmet liner including in combination a plurality of layers conforming generally to the top of a wearer's head, said layers being assembled in superposed contacting relationship with one another and each comprising a sheet having spaced projections comprising energy-absorbing material on at least one side thereof, said sheets being elastic at normal temperatures and plastically deformable at elevated temperatures to permit adjustment of the effective thickness of said liner.

3. A helmet liner including in combination a plurality of layers conforming generally to the top of a wearer's head, said layers being assembled in superposed contacting relationship with one another and each comprising a sheet having spaced projections on at least one side thereof, said layers being arranged with the projections of one sheet in register with the spaces between the projections of an adjacent sheet, said sheets being elastic at normal temperatures and plastically deformable at elevated temperatures to permit adjustment of the effective thickness of said liner.

4. A helmet liner including in combination a plurality of layers conforming generally to the top of a wearer's head, said layers being assembled in superposed contacting relationship with one another and each comprising a sheet formed with spaced pockets on at least one side thereof and respective spacing elements individually received by said pockets, said sheets being elastic at normal temperatures and plastically deformable at elevated temperatures to permit adjustment of the effective thickness of said liner.

5. A helmet liner as in claim 4 in which said spacing elements comprise hollow epoxy balloons.

6. A helmet liner as in claim 4 in which said spacing elements comprise spheres.

7. A helmet liner as in claim 4 in which said spacing elements comprise energy-absorbing material.

8. A helmet liner as in claim 4 in which said spacing elements are lockingly received by said pockets.

9. A helmet liner including in combination a plurality of layers conforming generally to the top of a wearer's head, said layers being assembled in superposed contacting relationship with one another and each comprising a sheet formed with spaced pockets on at least one side thereof and respective spacing elements individually received by said pockets, said layers being arranged with the spacing elements of one sheet in register with the spaces between the elements of an adjacent sheet, said sheets being elastic at normal temperatures and plastically deformable at elevated temperatures to permit adjustment of the effective thickness of said liner.

10. A helmet liner including in combination a plurality of layers conforming generally to the top of a wearer's head, said layers being assembled in superposed contacting relationship with one another and each comprising a sheet having spaced projections on at least one side thereof, said sheet comprising a material having an elasticity that increases with increasing temperature.

11. A method of custom-fitting a helmet liner having a plurality of elastic thermoplastic layers conforming generally to the top of a wearer's head, said layers being assembled in superposed contacting relationship with one another and each comprising a sheet having spaced projections on at least one side thereof, said method including the steps of heating said sheets to a plastic state and deforming said sheets to adjust the effective thickness of said liner.

12. A method of custom-fitting a helmet liner having a plurality of elastic thermoplastic layers conforming generally to the top of a wearer's head, said layers being assembled in superposed contacting relationship with one another and each comprising a sheet having spaced projections on at least one side thereof, said method including the steps of heating said sheets to a plastic state and placing said liner on the wearer's head to deform said sheets to adjust the effective thickness of said liner.

13. A method of custom-fitting a helmet liner having a plurality of elastic thermoplastic layers conforming generally to the top of a wearer's head, said layers being assembled in superposed contacting relationship with one another and each comprising a sheet having spaced projections on at least one side thereof, said method including the steps of heating said sheets to a plastic state and placing said liner between the wearer's head and a rigid outer member to deform said sheets to adjust the effective thickness of said liner.

* * * * *